US009838812B1

(12) United States Patent
Shetye et al.

(10) Patent No.: US 9,838,812 B1
(45) Date of Patent: Dec. 5, 2017

(54) ON/OFF HEAD DETECTION OF PERSONAL ACOUSTIC DEVICE USING AN EARPIECE MICROPHONE

(71) Applicant: Bose Corporation, Framingham, MA (US)

(72) Inventors: Mihir D. Shetye, Ashland, MA (US); Binu K. Oommen, Milford, MA (US); Dale McElhone, Marlborough, MA (US)

(73) Assignee: BOSE CORPORATION, Framingham, MA (US)

( * ) Notice: Subject to any disclaimer, the term of this patent is extended or adjusted under 35 U.S.C. 154(b) by 0 days.

(21) Appl. No.: 15/342,599

(22) Filed: Nov. 3, 2016

(51) Int. Cl.
*H04R 29/00* (2006.01)
*H04R 1/10* (2006.01)

(52) U.S. Cl.
CPC ..... *H04R 29/001* (2013.01); *H04R 1/1091* (2013.01); *H04R 2460/01* (2013.01)

(58) Field of Classification Search
CPC ..... H04R 29/00
See application file for complete search history.

(56) References Cited

U.S. PATENT DOCUMENTS

| | | | |
|---|---|---|---|
| 4,955,729 | A | 9/1990 | Marx |
| 5,144,678 | A | 9/1992 | Lenz |
| 5,471,538 | A | 11/1995 | Sasaki et al. |
| 5,577,511 | A | 11/1996 | Killion |
| 5,708,725 | A | 1/1998 | Ito |
| 6,118,878 | A | 9/2000 | Jones |
| 6,163,610 | A | 12/2000 | Bartlett et al. |
| 6,532,294 | B1 | 3/2003 | Rudell |
| 6,542,436 | B1 | 4/2003 | Myllyla |
| 6,567,524 | B1 | 5/2003 | Svean et al. |
| 6,639,987 | B2 | 10/2003 | McIntosh |

(Continued)

FOREIGN PATENT DOCUMENTS

| | | |
|---|---|---|
| DE | 102007013719 | 9/2008 |
| EP | 0363056 | 4/1990 |

(Continued)

OTHER PUBLICATIONS

Examination Report in European Patent Application No. 09719786.7, dated Mar. 15, 2011; 6 pages.

(Continued)

*Primary Examiner* — Olisa Anwah
(74) *Attorney, Agent, or Firm* — Schmeiser, Olsen & Watts LLP; William G. Guerin

(57) ABSTRACT

A method of controlling a personal acoustic device includes generating a first electrical signal responsive to an acoustic signal incident at a microphone disposed on an earpiece of the personal acoustic device. A characteristic of a transfer function based on the first electrical signal and a second electrical signal provided to a speaker in the earpiece is determined. An operating state of the personal acoustic device is determined form the characteristic of the transfer function. The operating state include a state in which the earpiece is positioned in the vicinity of an ear of a user and a second state in which the earpiece is absent from the vicinity of the ear of the user. Examples of a microphone that may be used include feedback and feedforward microphones in an acoustic noise reduction circuit.

23 Claims, 9 Drawing Sheets

(56) References Cited

U.S. PATENT DOCUMENTS

| | | | | |
|---|---|---|---|---|
| 6,687,377 | B2 | 2/2004 | Voix et al. | |
| 6,704,428 | B1 | 3/2004 | Wurtz | |
| 6,763,116 | B2 | 7/2004 | Barthel et al. | |
| 7,039,195 | B1 | 5/2006 | Svean et al. | |
| 7,406,179 | B2 * | 7/2008 | Ryan | H04R 1/10 381/312 |
| 7,418,103 | B2 | 8/2008 | Sargaison | |
| 7,433,481 | B2 | 10/2008 | Armstrong et al. | |
| 7,450,730 | B2 | 11/2008 | Berg et al. | |
| 7,522,739 | B2 | 4/2009 | Rass et al. | |
| 7,639,827 | B2 | 12/2009 | Bachler | |
| 7,783,057 | B2 | 8/2010 | Park | |
| 7,925,029 | B2 | 4/2011 | Hollemans et al. | |
| 8,238,567 | B2 | 8/2012 | Burge et al. | |
| 8,243,946 | B2 | 8/2012 | Burge et al. | |
| 8,699,719 | B2 | 4/2014 | Johnson, Jr. et al. | |
| 2002/0076057 | A1 | 6/2002 | Voix | |
| 2003/0147544 | A1 * | 8/2003 | Lichtblau | H04R 25/453 381/317 |
| 2003/0161479 | A1 | 8/2003 | Yang et al. | |
| 2004/0264706 | A1 | 12/2004 | Ray et al. | |
| 2005/0226446 | A1 | 10/2005 | Luo et al. | |
| 2006/0013079 | A1 | 1/2006 | Rekimoto | |
| 2006/0029234 | A1 | 2/2006 | Sargaison | |
| 2006/0045304 | A1 | 3/2006 | Lee et al. | |
| 2006/0215847 | A1 | 9/2006 | Hollemans et al. | |
| 2007/0076897 | A1 * | 4/2007 | Philipp | H04R 1/1041 381/74 |
| 2007/0154049 | A1 | 7/2007 | Levitsky et al. | |
| 2007/0160255 | A1 | 7/2007 | Cheng et al. | |
| 2007/0274530 | A1 | 11/2007 | Buil et al. | |
| 2007/0297618 | A1 | 12/2007 | Nurmi et al. | |
| 2007/0297634 | A1 | 12/2007 | Hansson | |
| 2008/0080705 | A1 | 4/2008 | Gerhardt et al. | |
| 2008/0107287 | A1 | 5/2008 | Beard | |
| 2008/0192942 | A1 | 8/2008 | Yamkovoy et al. | |
| 2008/0260176 | A1 | 10/2008 | Hollemans et al. | |
| 2009/0154720 | A1 | 6/2009 | Oki | |
| 2009/0268936 | A1 | 10/2009 | Goldberg et al. | |
| 2010/0054518 | A1 | 3/2010 | Goldin | |
| 2010/0128887 | A1 | 5/2010 | Lee et al. | |
| 2010/0183183 | A1 | 7/2010 | Bae et al. | |
| 2010/0189268 | A1 | 7/2010 | Haartsen et al. | |
| 2010/0246845 | A1 | 9/2010 | Burge et al. | |
| 2010/0246846 | A1 | 9/2010 | Burge et al. | |
| 2010/0246847 | A1 | 9/2010 | Johnson et al. | |
| 2011/0144779 | A1 | 6/2011 | Janse et al. | |
| 2011/0293129 | A1 | 12/2011 | Dillen et al. | |
| 2012/0002822 | A1 | 1/2012 | Peissig et al. | |

FOREIGN PATENT DOCUMENTS

| | | |
|---|---|---|
| EP | 1059635 | 12/2000 |
| EP | 1465454 | 10/2004 |
| JP | 07-298383 | 11/1995 |
| WO | 2007049255 | 5/2007 |
| WO | 2007110807 | 10/2007 |
| WO | 2007141769 | 12/2007 |
| WO | 2008096125 | 8/2008 |

OTHER PUBLICATIONS

International Preliminary Report on Patentability in International Patent Application No. PCT/U509/35826, dated Jun. 1, 2010; 19 pages.

International Search Report & Written Opinion in International Patent Application No. PCT/US10/29031, dated Aug. 10, 2010; 22 pages.

International Search Report & Written Opinion in International Patent Application No. PCT/US09/35826, dated Jun. 16, 2009; 12 pages.

Invitation to Pay Additional Fees in International Patent Application No. PCT/US10/29031, mailed on May 26, 2010; 7 pages.

Related U.S. Appl. No. 15/157,807, filed May 18, 2016; 25 pages.

* cited by examiner

ON/OFF HEAD DETECTION OF PERSONAL ACOUSTIC DEVICE USING AN EARPIECE MICROPHONE

BACKGROUND

This disclosure relates to the determination of the position of at least one earpiece of a personal acoustic device relative to an ear of a user. Operation of the personal acoustic device may be controlled according to the determination of the position.

SUMMARY

In one aspect, a method of controlling a personal acoustic device includes generating a first electrical signal responsive to an acoustic signal incident at a microphone disposed on an earpiece of the personal acoustic device. A characteristic of a transfer function based on the first electrical signal and a second electrical signal provided to a speaker in the earpiece is determined and an operating state of the personal acoustic device based on the characteristic of the transfer function is determined. The operating state includes at least a first state in which the earpiece is positioned in the vicinity of an ear of a user and a second state in which the earpiece is absent from the vicinity of the ear.

Examples may include one or more of the following features:

The microphone may be disposed at a location on the earpiece such that the microphone is in an acoustic cavity formed by the earpiece and at least one of a head of a user or the ear of the user when the earpiece is positioned in the vicinity of the ear of the user. The microphone may be disposed at a location on the earpiece such that the microphone is acoustically coupled to an environment external to the earpiece.

The characteristic of the transfer function may be a magnitude of the transfer function at one or more predetermined frequencies, a power spectrum over a predefined frequency range or a phase of the transfer function at a predetermined frequency. The predetermined frequency may be about 1.5 KHz.

The second signal may include a tone. The tone may be less than 20 Hz. The tone may be in a frequency range from approximately 5 Hz to about 300 Hz. The tone may in a frequency range from about 300 Hz to about 1 KHz. The tone may be about 1.5 KHz.

The second electrical signal may include an audio content signal.

The method may further include generating the second electrical signal.

The steps of generating the first electrical signal and determining the characteristic of the transfer function may be performed for each earpiece in a pair of earpieces and the step of determining the operating state of the personal acoustic device may further include comparing the characteristic of the transfer functions of the earpieces.

The method may further include initiating an operation of the personal acoustic device or a device in communication with the personal acoustic device when the determining of the operating state of the personal acoustic device indicates a change in the operating state. Initiating the operation may include at least one of: changing a power state, changing an active noise reduction state and changing an audio output state of the personal acoustic device or a device in communication with the personal acoustic device.

The earpiece may be one of an in-ear headphone, an on-ear headphone or an around-ear headphone.

In accordance with another aspect, a personal acoustic device includes an earpiece and a control circuit. The earpiece has a microphone and is configured for attachment to a head of a user or an ear of the user. The microphone is configured to generate a first electrical signal responsive to an acoustic signal incident at the microphone. The earpiece has a speaker configured to generate an audio signal in response to a second electrical signal. The control circuit is in communication with the microphone to receive the first electrical signal and is in communication with the speaker for providing the second electrical signal. The control circuit is configured to determine a characteristic of a transfer function based on the first electrical signal and the second electrical signal. The control circuit is further configured to determine an operating state of the personal acoustic device based on the characteristic of the transfer function. The operating state includes at least a first state in which the earpiece is positioned in the vicinity of the ear and a second state in which the earpiece absent from the vicinity of the ear.

Examples may include one or more of the following features:

The microphone may be disposed at a location on the earpiece such that the microphone is in an acoustic cavity formed by the earpiece and at least one of the head or the ear when the earpiece is positioned in the vicinity of the ear of the user. The microphone may be disposed at a location on the earpiece such that the microphone is acoustically coupled to an environment external to the earpiece.

The control circuit may include a digital signal processor.

The microphone may be a feedback microphone in an acoustic noise reduction circuit.

The personal acoustic device may further include a power source in communication with the control circuit and the control circuit may be configured to change a power state of the personal acoustic device when the operating state of the earpiece is determined to have changed.

The personal acoustic device may further include a device in communication with the control circuit and the control circuit may be configured to control an operation of the device in response to a determination that the operating state of the earpiece is determined to have changed.

BRIEF DESCRIPTION OF THE DRAWINGS

The above and further advantages of examples of the present inventive concepts may be better understood by referring to the following description in conjunction with the accompanying drawings, in which like numerals indicate like structural elements and features in various figures. The drawings are not necessarily to scale, emphasis instead being placed upon illustrating the principles of features and implementations.

DETAILED DESCRIPTION

Figure 1:
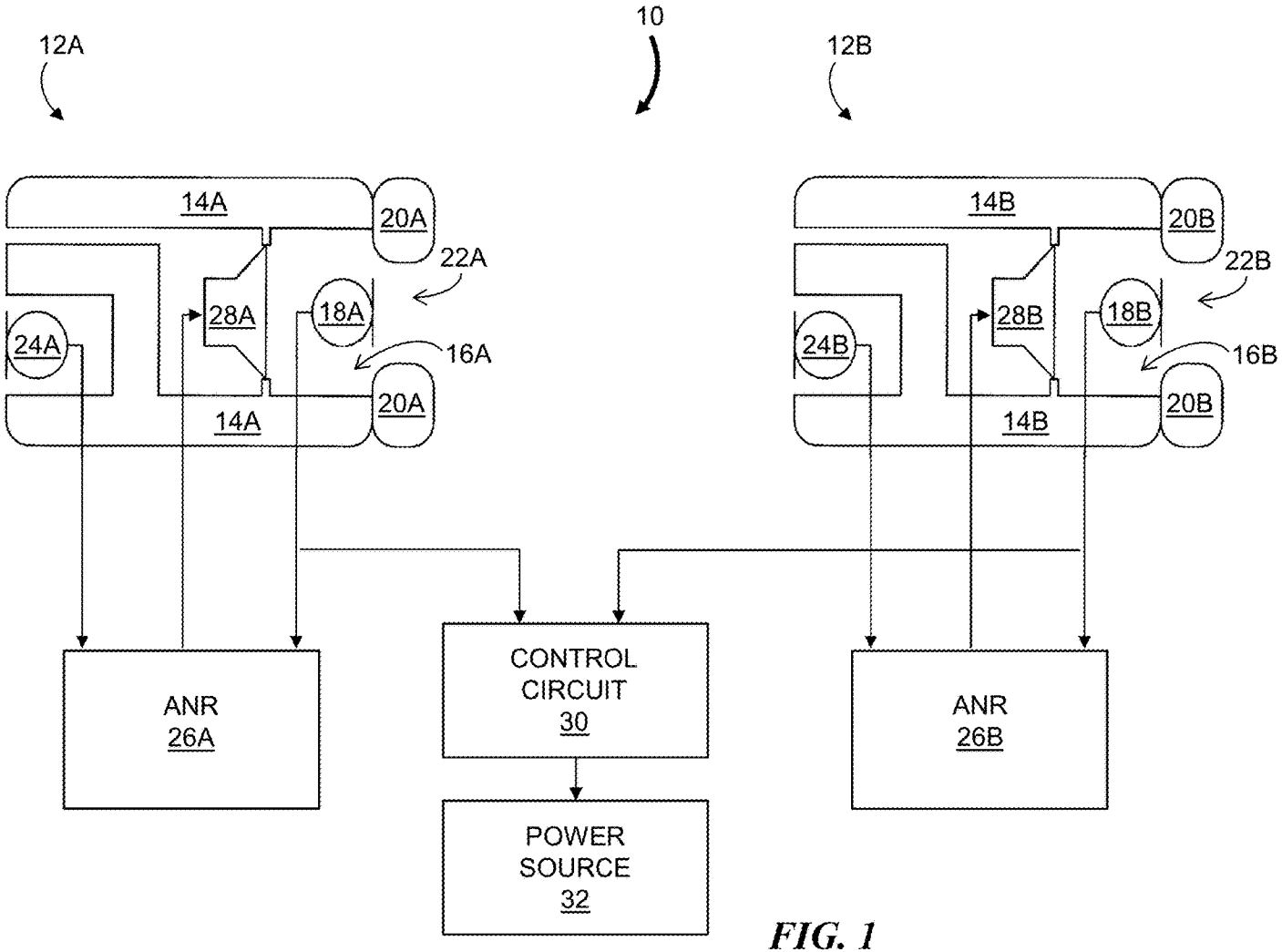
FIG. 1 is a block diagram of an example of a personal acoustic device that can determine an on head or off head operating state according to the positioning of at least one earpiece.

It has become commonplace for those who either listen to electronically provided audio (e.g., audio from an audio source such as a mobile phone, tablet, computer, CD player, radio or MP3 player), those who simply seek to be acoustically isolated from unwanted or possibly harmful sounds in a given environment and those engaging in two-way communications to employ personal acoustic devices (i.e., devices structured to be positioned in, over or around at least one of a user's ears) to perform these functions. For those who employ headphones or headset forms of personal acoustic devices to listen to electronically provided audio, it is commonplace for that audio to be provided with at least two audio channels (e.g., stereo audio with left and right channels) to be separately acoustically output with separate earpieces to each ear. Further, developments in digital signal processing (DSP) technology have enabled such provision of audio with various forms of surround sound involving multiple audio channels. For those simply seeking to be acoustically isolated from unwanted or possibly harmful sounds, it has become commonplace for acoustic isolation to be achieved through the use of active noise reduction (ANR) techniques based on the acoustic output of anti-noise sounds in addition to passive noise reduction (PNR) techniques based on sound absorbing and/or reflecting materials. Further, it is commonplace to combine ANR with other audio functions in headphones, headsets, earphones, earbuds and wireless headsets (also known as "earsets").

Despite these advances, issues of user safety and ease of use of many personal acoustic devices remain unresolved. More specifically, controls (e.g., a power switch) mounted on or otherwise connected to a personal acoustic device that are normally operated by a user upon either positioning the personal acoustic device in, over or around one or both ears or removing it therefrom are often undesirably cumbersome to use. The cumbersome nature of the controls often arises from the need to minimize the size and weight of such devices by minimizing the physical size of the controls. Also, controls of other devices with which a personal acoustic device interacts are often inconveniently located relative to the personal acoustic device and/or a user. Further, regardless of whether such controls are in some way carried by the personal acoustic device or by another device with which the personal acoustic device interacts, it is commonplace for users to forget to operate these controls when they position the acoustic device in, over or around one or both ears or remove it therefrom.

Various enhancements in safety and/or ease of use may be realized through the provision of an automated ability to determine the positioning of an earpiece of a personal acoustic device relative to a user's ear. The positioning of an earpiece in, over or around a user's ear, or "in the vicinity of a user's ear," may be referred to below as an "on head" operating state. Conversely, the positioning of an earpiece so that it is absent from a user's ear, or not in the vicinity of a user's ear, may be referred to below as an "off head" operating state.

Methods have been developed for determining the operating state of an earpiece as being on head or off head. Certain methods for determining the operating state for a personal acoustic device having ANR capability by analyzing the inner and/or outer signals are described, for example, in U.S. Pat. No. 8,238,567, "Personal Acoustic Device Position Determination," U.S. Pat. No. 8,699,719, "Personal Acoustic Device Position Determination," and U.S. patent application Ser. No. 15/157,807, "On/Off Head Detection of Personal Acoustic Device," the disclosures of which are incorporated herein by reference in their entirety. Knowledge of a change in the operating state from on head to off head, or from off head to on head, can be applied for different purposes. For example, features of the personal acoustic device may be enabled or disabled according to a change of operating state. In a specific example, upon determining that at least one of the earpieces of a personal acoustic device has been removed from a user's ear to become off head, power supplied to the device may be reduced or terminated. Power control executed in this manner can result in longer durations between charging of one or more batteries used to power the device and can increase battery lifetime. Optionally, a determination that one or more earpieces have been returned to the user's ear can be used to resume or increase the power supplied to the device.

In the examples of a personal acoustic device and a method of controlling a personal acoustic device described below, certain terminology is used to better facilitate understanding of the examples. As used herein, a headset means any device having at least one earpiece that may be worn in or about the ear of a user or on the head of a user. Reference is made to one or more "tones" where a tone means a substantially single frequency signal. The tone may have a bandwidth beyond that of a single frequency, and/or may include a small frequency range that includes the value of the single frequency. For example, a 10 Hz tone may include a signal that has frequency content in a range about 10 Hz.

FIG. 1 is a block diagram of an example of a personal acoustic device 10 having two earpieces 12A and 12B, each configured to direct sound towards an ear of a user. Reference numbers appended with an "A" or a "B" indicate a correspondence of the identified feature with a particular one of the earpieces 12 (e.g., a left earpiece 12A and a right earpiece 12B). Each earpiece 12 includes a casing 14 that defines a cavity 16 in which at least one internal microphone (inner microphone) 18 may be disposed. An ear coupling 20 (e.g., an ear tip or ear cushion) attached to the casing 14 surrounds an opening to the cavity 16. A passage 22 is formed through the ear coupling 20 and communicates with the opening to the cavity 16. In some implementations, a substantially acoustically transparent screen or grill (not shown) is provided in or near the passage 22 to obscure the inner microphone 18 from view or to prevent damage to the inner microphone 18. In some examples, an outer microphone 24 is disposed on the casing in a manner that permits acoustic coupling to the environment external to the casing. In some implementations, the inner microphone 18 is a feedback microphone and the outer microphone 24 is a feedforward microphone. For the examples of a personal acoustic device and a method of controlling a personal acoustic device described below, one or both of the inner microphone 18 and outer microphone 24 may be present.

Each earphone 12 includes an ANR circuit 26 that is in communication with the inner and outer microphones 18 and 24. The ANR circuit 26 receives an inner signal generated by the inner microphone 18 and an outer signal generated by the outer microphone 24, and performs an ANR process for the corresponding earpiece 12. The process includes providing a signal to an electroacoustic transducer (e.g., speaker) 28 disposed in the cavity 16 to generate an anti-noise acoustic signal that reduces or substantially prevents sound from one or more acoustic noise sources that are external to the earphone 12 from being heard by the user.

As illustrated, a control circuit 30 is in communication with the inner microphones 18 and receives the two inner signals. Alternatively, the control circuit 30 may be in communication with the outer microphones 24 and receives the two outer signals. In another alterative, the control circuit 30 may be in communication with both the inner microphones 18 and outer microphones 24, and receives the two inner and two outer signals. In certain examples, the control circuit 30 includes a microcontroller or processor having a digital signal processor (DSP) and the inner signals from the two inner microphones 18 and/or the outer signals from the two outer microphones 24 are converted to digital format by analog to digital converters. In response to the received inner and/or outer signals, the control circuit 30 can take various actions. For example, the power supplied to the personal acoustic device 10 may be reduced upon a determination that one or both earpieces 12 are off head. In another example, full power may be returned to the device 10 in response to a determination that at least one earpiece becomes on head. Other aspects of the personal acoustic device 10 may be modified or controlled in response to determining that a change in the operating state of the earpiece 12 has occurred. For example, ANR functionality may be enabled or disabled, audio playback may be initiated, paused or resumed, a notification to a wearer may be altered, and a device in communication with the personal acoustic device may be controlled. As illustrated, the control circuit 30 generates a signal that is used to control a power source 32 for the device 10. The control circuit 30 and power source 32 may be in one or both of the earpieces 12 or may be in a separate housing in communication with the earpieces 12.

When an earpiece 12 is positioned on head, the ear coupling 20 engages portions of the ear and/or portions of the user's head adjacent to the ear, and the passage 22 is positioned to face the entrance to the ear canal. As a result, the cavity 16 and the passage 22 are acoustically coupled to the ear canal. At least some degree of acoustic seal is formed between the ear coupling 20 and the portions of the ear and/or the head of the user that the ear coupling 20 engages. This acoustic seal at least partially acoustically isolates the now acoustically coupled cavity 16, passage 22 and ear canal from the environment external to the casing 14 and the user's head. This enables the casing 14, the ear coupling 20 and portions of the ear and/or the user's head to cooperate to provide some degree of PNR. Consequently, sound emitted from external acoustic noise sources is attenuated to at least some degree before reaching the cavity 16, the passage 22 and the ear canal. Sound generated by each speaker 28 propagates within the cavity 16 and passage 22 of the earpiece 12 and the ear canal of the user, and may reflect from surfaces of the casing 14, ear coupling 20 and ear canal. This sound can be sensed by the inner microphone 18. Thus the inner signal is responsive to the sound generated by the speaker 28.

When the earpiece 12 is removed from the user so that it is off head and the ear coupling 20 no longer engages the head of the user, the cavity 16 and the passage 22 are acoustically coupled to the environment external to the casing 14. This allows the sound from the speaker 28 to propagate through the cavity 16 and the passage 22, and into the external environment. The sound is not restricted to the small volume defined by the cavity 16, passage 22 and ear canal. Consequently, the transfer function defined by the inner signal of the inner microphone 18 relative to the signal driving the speaker 28 typically differs for the two operating states. In particular, the magnitude characteristic of the transfer function for the on head operating state is different from the magnitude characteristic of the transfer function for the off head operating state. Similarly, the phase characteristic of the transfer function for the on head operating state is different from the phase characteristic of the transfer function for the off head operating state.

The outer signals generated by the outer microphones 24 may be used in a complementary manner. When the earpiece 12 is positioned on head, the cavity 16 and the passage 22 are at least partially acoustically isolated from the external environment due to the acoustic seal formed between the ear coupling 20 and the portions of the ear and/or the head of the user. Thus sound emitted from the speakers 28 is attenuated before reaching the outer microphones 24. Consequently, the outer signals are generally substantially non-responsive to the sound generated by the speakers 28 while the earpiece 12 is in an on head operating state.

When the earpiece 12 is removed from the user so that it is off head and the ear coupling 20 is therefore disengaged from the user's head, the cavity 16 and the passage 22 are acoustically coupled to the environment external to the casing 14. This allows the sound from the speaker 28 to propagate into the external environment. As a result, the transfer function defined by the outer signal of the outer microphone 24 relative to the signal driving the speaker 28 generally differs for the two operating states. More particularly, the magnitude and phase characteristics of the transfer function for the on head operating state are different from the magnitude and phase characteristics of the transfer function for the off head operating state.

Figure 2A:
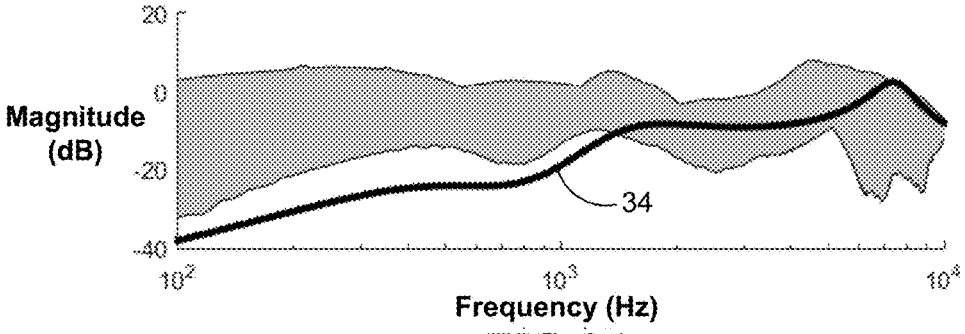
FIG. 2A is a graphical representation of the magnitude characteristic of a transfer function defined by an inner signal of an inner microphone relative to a speaker drive signal for on head and off head operating states of an in-ear acoustic noise cancelling headphone.
Figure 2B:
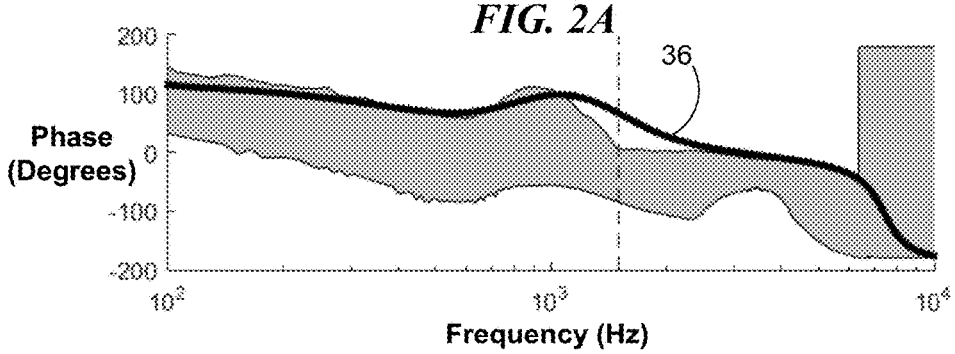
FIG. 2B shows the phase characteristic of a transfer function defined by an inner signal of an inner microphone relative to a speaker drive signal for on head and off head operating states of an in-ear acoustic noise cancelling headphone.

The transfer functions can be determined by measurement. For example, in the case where the inner microphone signal is used, the magnitude of the transfer function defined by the inner signal of the inner microphone 18 relative to the signal driving the speaker 28 for a sample of approximately 60 users is shown in FIG. 2A for both on head and off head operating states for an in-ear acoustic noise cancelling headphone. FIG. 2B shows the phase of the transfer function defined by the inner signal of the inner microphone 18 relative to the signal driving the speaker 28 for the same headphone and sample of users for both operating states. The gray areas in FIGS. 2A and 2B correspond to an envelope encompassing the magnitude or phase characteristic, respectively, of the transfer functions of the sampled users.

A wide variation in the magnitudes for the on head operating state is evident across all shown frequencies and is due in part to variations in how the earpieces rests against each user's head. In the case of an in-ear headphone (as in FIGS. 2A-2B), these variations can be due to the varying fit of the ear tips in different users' ears. In the case of an on-ear or around-ear headphone (as in FIGS. 3A-4B), these variations can be due to physical differences between users such as the user's hair and the wearing of glasses which can affect how well the earpiece is seated against the user's head. It will be recognized by those of skill in the art that the transfer functions are generally different for other models and types of earpieces because the location of the inner microphone 18 relative to the speaker 28 will typically be different. Plotted lines 34 and 36 in FIGS. 2A and 2B, respectively, show the magnitude and phase, respectively, of the transfer function for the off head operating state. Unlike the on head operating state, the magnitude and phase for the off head operating state is substantially the same for all users as the physical characteristics of each user and the goodness of fit are generally not relevant to the off head transfer function.

It can be seen from FIG. 2A that the magnitude of a single frequency signal (i.e., a tone) sensed by the inner microphone of the earpiece can be compared to the magnitude 34 of the transfer function for the off head operating state at the same frequency in a frequency range extending up to approximately several hundred Hz. In this frequency range the on head magnitudes are distinct from the off head magnitude 34. If the magnitude of the inner signal exceeds the magnitude 34 for the off head operating state, a decision can be made that the earpiece 12 is on head. In one example, the decision that the earpiece is on head is based on exceeding the predetermined magnitude (plot 34 at the tone frequency) by a predefined difference (in one non-limiting example 10 dB). Conversely, if the magnitude of the inner signal at the tone frequency does not exceed the predetermined magnitude 34 (or the predetermined magnitude and predefined difference) for the off head operating state, a determination is made that the earpiece is off head.

It can be seen from FIG. 2B that the phase of a tone sensed by the inner microphone can be compared to the phase 36 of the transfer function for the off head operating state at the same frequency for a range of frequencies inclusive of approximately 1.5 KHz (indicated by dashed vertical line) where the on head phases are distinct from the off head phase 36. If the phase of the inner signal is less than the phase 36 for the off head operating state, a decision can be made that the earpiece 12 is on head. In one example, the decision that the earpiece 12 is on head is based on the predetermined phase 36 at the tone frequency exceeding the phase by a predefined difference (in one non-limiting example 10 degrees). Conversely, if the phase of the inner signal at the tone frequency does not exceed the predetermined phase 36 (and/or the predetermined magnitude and predefined difference) for the off head operating state, a determination is made that the earpiece is off head.

Figure 3A:
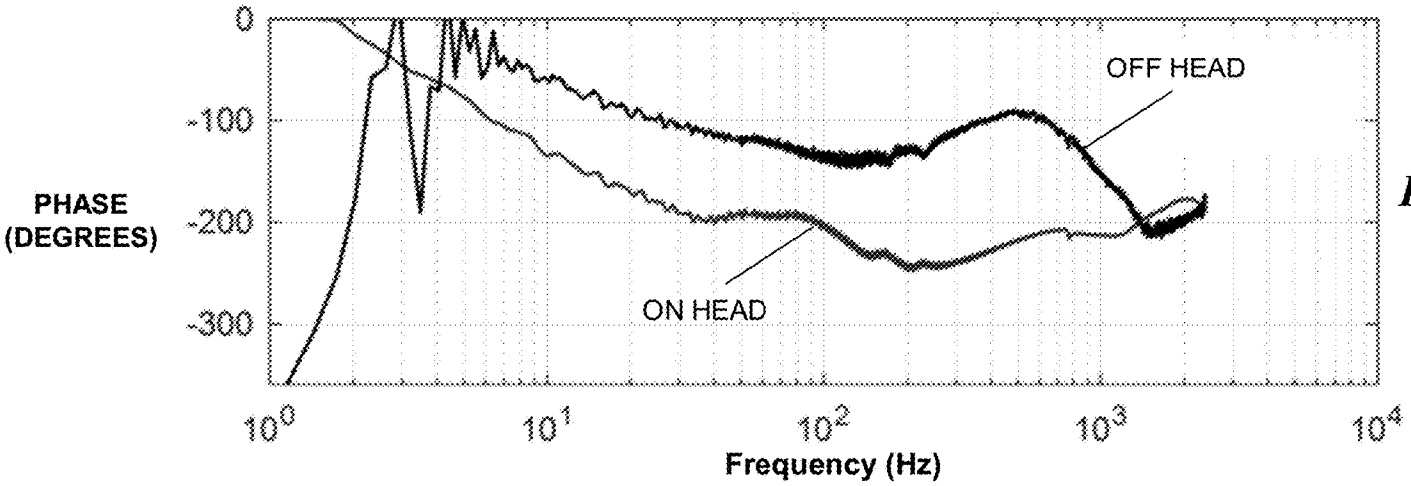
FIG. 3A is a graphical representation depicting the phase characteristic of a transfer function defined by an inner signal of an inner microphone relative to a speaker drive signal for a single user for a left earpiece.
Figure 3B:
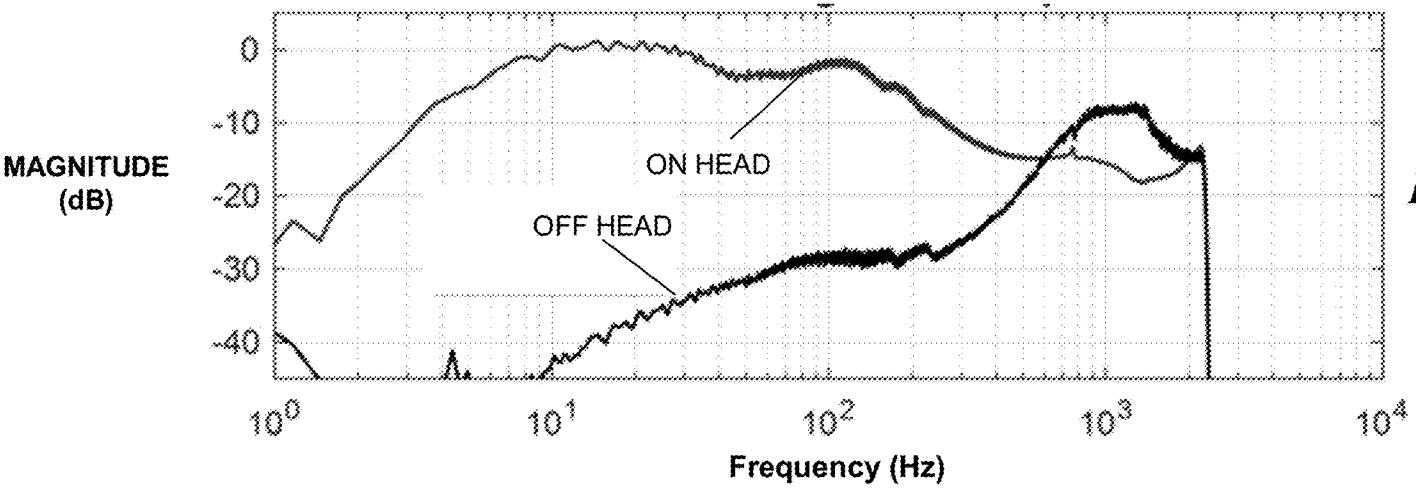
FIG. 3B is a graphical representation depicting the magnitude characteristic of a transfer function defined by an inner signal of an inner microphone relative to a speaker drive signal for a single user for a left earpiece.
Figure 4A:
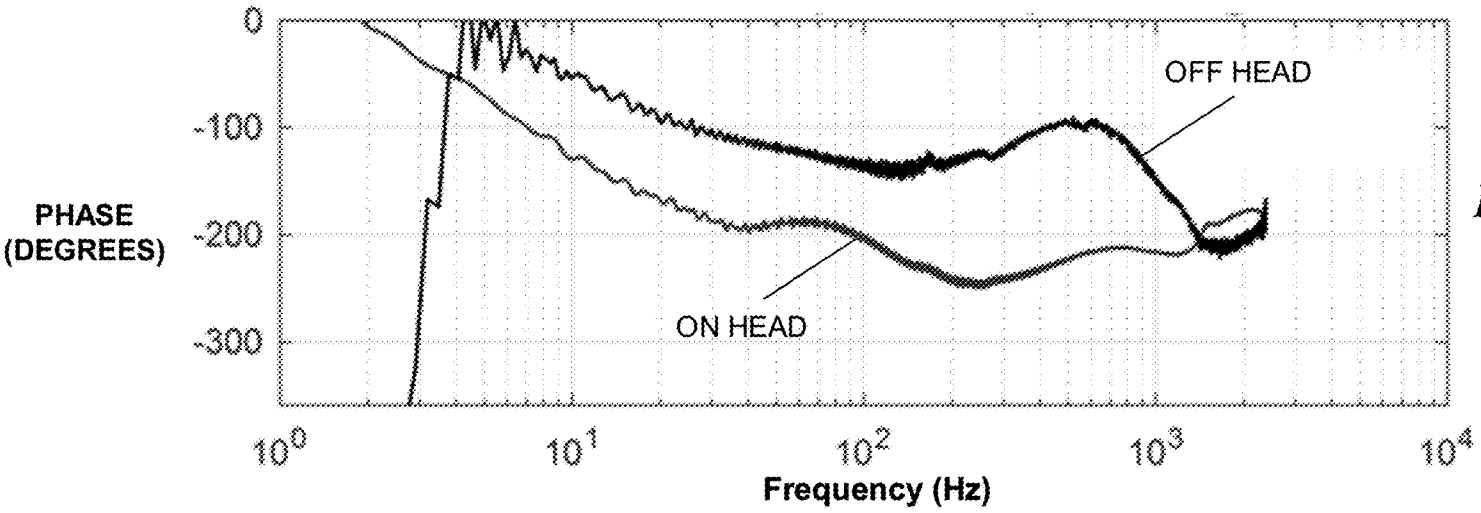
FIG. 4A is a graphical representation depicting the phase characteristic of a transfer function defined by an inner signal of an inner microphone relative to a speaker drive signal for a single user for a right earpiece.
Figure 4B:
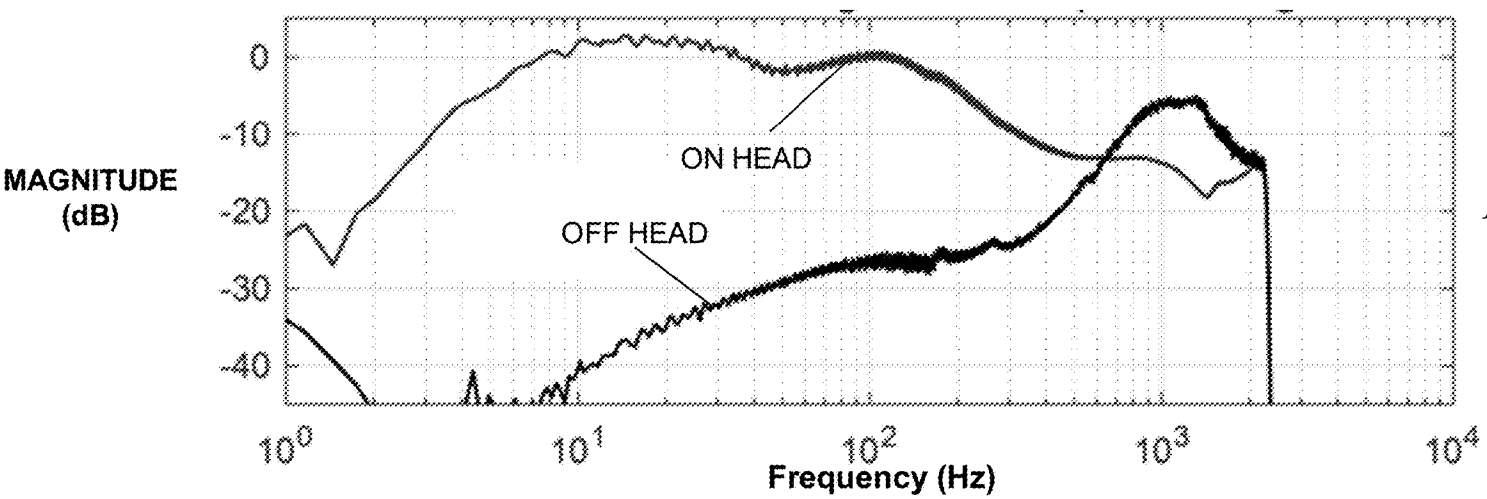
FIG. 4B is a graphical representation depicting the magnitude characteristic of a transfer function defined by an inner signal of an inner microphone relative to a speaker drive signal for a single user for a right earpiece.

FIG. 3A and FIG. 3B show plots depicting the phase and the magnitude characteristics, respectively, of a transfer function defined by the inner signal of the inner microphone 18 relative to the signal driving the speaker 28 for a single user for a left earpiece. Similarly, FIGS. 4A and 4B show plots depicting the phase and the magnitude characteristics, respectively, of a transfer function defined by the inner signal of the inner microphone 18 relative to the signal driving the speaker 28 for the right ear of the same user. FIGS. 3A-3B and 4A-4B were generated using a QuietComfort® 25 Acoustic Noise Cancelling® headphone available from Bose Corporation of Framingham, Mass. Each figure also includes the corresponding phase or magnitude for the off head operating state. It can be observed that the characteristics of the left and right ear transfer functions for the on head operating state are similar. Moreover, it can readily be seen (similar to the case of an in-ear headphone as described above with reference to FIGS. 2A-2B) that the difference of the plotted characteristics for the on head versus off head operating states is significant over broad frequency bands for both phase and magnitude characteristics. For example, at 10 Hz there is a magnitude difference of approximately 40 dB. Accordingly, it may be preferred to "calibrate" a headset for a particular user to enable a more accurate determination of the operating state of the headset as opposed to calibrating according to a group of users. In one implementation, the headset may be calibrated for individual users and the determined on head characteristics stored according to each particular user for subsequent use by that user.

Figure 5:
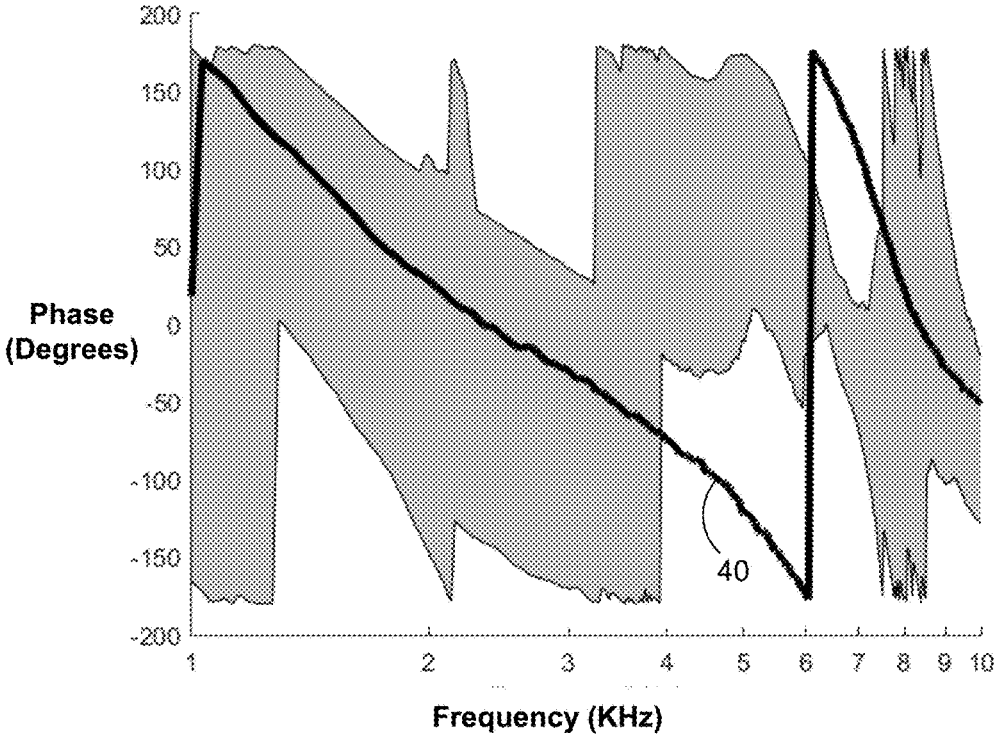
FIG. 5 is a graphical representation of the phase characteristic of a transfer function defined by an outer signal of an outer microphone relative to a speaker drive signal for multiple users for an in-ear acoustic noise cancelling headphone.

FIG. 5 shows the phase characteristic of a transfer function for a case in which the outer signal from an outer microphone 24 is used. The transfer function is defined by the outer signal relative to the signal driving the speaker 28 for multiple users for an in-ear acoustic noise cancelling headphone similar to that used for the transfer functions shown in FIGS. 2A and 2B. The gray area in the figure corresponds to an envelope encompassing the phase characteristic for all the users for the on head operating state and the solid line 40 represents the phase characteristic for the off head operating state. It can be seen that the phase is distinct for the two operating states over a range of frequencies extending from approximately 4 KHz to greater than 7 KHz.

Figure 6A:
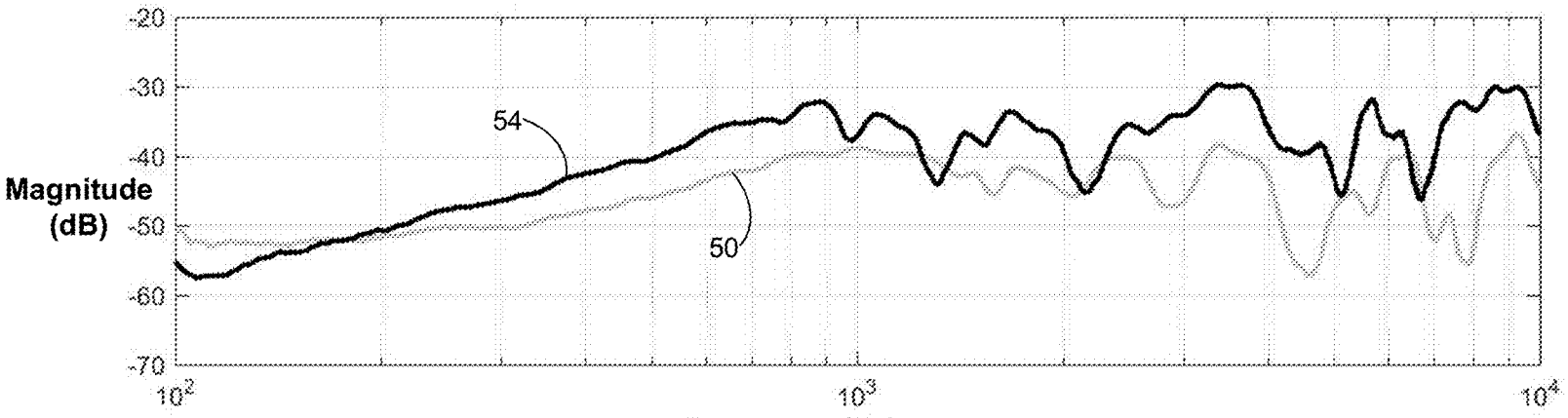
FIG. 6A is a graphical representation of the magnitude characteristic of a transfer function defined by an outer signal of an outer microphone relative to a speaker drive signal for a single user for one earpiece of an around-ear headphone.
Figure 6B:
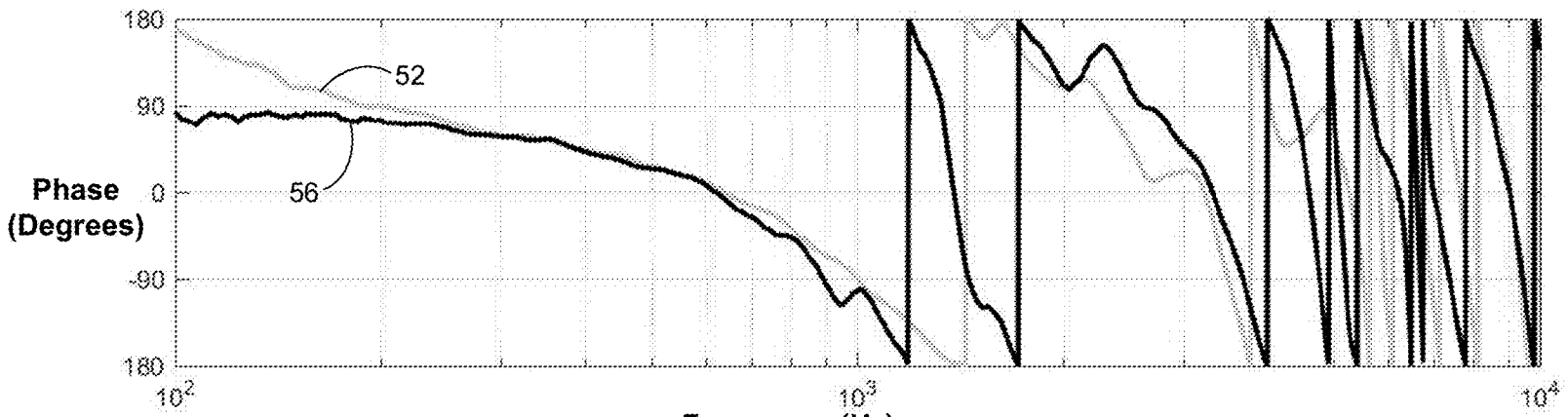
FIG. 6B is a graphical representation of the phase characteristic of a transfer function defined by an outer signal of an outer microphone relative to a speaker drive signal for a single user for one earpiece of an around-ear headphone.

FIG. 6A and FIG. 6B show plots depicting the magnitude and phase characteristics, respectively, of a transfer function defined by the outer signal relative to the speaker drive signal for a single user for one earpiece of an around-ear headphone. Plots 50 and 52 are associated with the on head operating state for a single user. Plots 54 and 56 are associated with the off head state for the user. The measurements for the plots were generated using the QuietComfort® 25 Acoustic Noise Cancelling® headphone described above with respect to FIGS. 3A-4B. It can be seen from the figure that there is a difference in magnitude for on head and off head operating states over a range of frequencies extending from less than 300 Hz to approximately 1 KHz and over other frequency ranges at higher frequencies. In addition, there are multiple ranges of frequencies over which there are differences in phase suitable for determining an on head or off head operating state.

Figure 7:
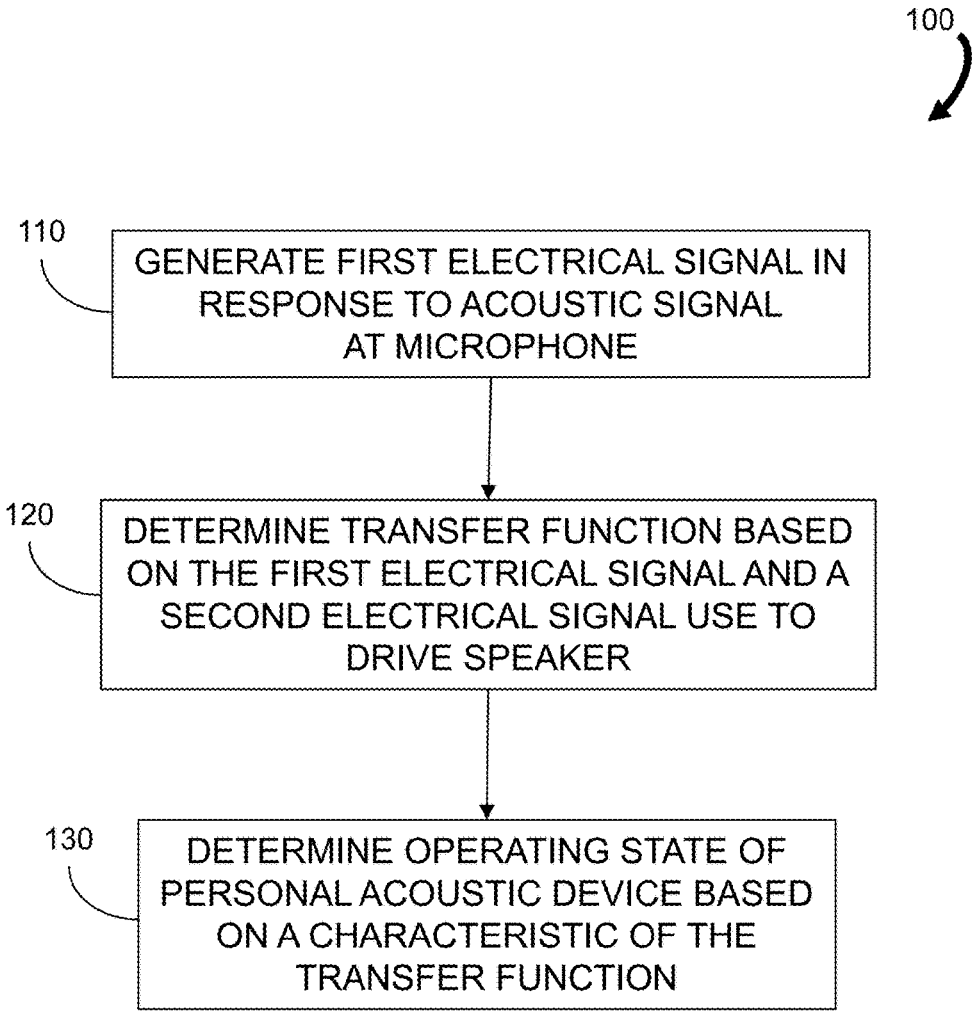
FIG. 7 is a flowchart representation of an example of a method of controlling a personal acoustic device.

FIG. 7 is a flowchart representation of an example of a method 100 of controlling a personal acoustic device. The method 100 includes generating 110 a first electrical signal that is responsive to an acoustic signal received at a microphone disposed on an earpiece of a personal acoustic device. The microphone may be at a location on the earpiece such that it is in an acoustic cavity formed by the earpiece and the head and/or ear of a user, or the microphone may be at a location on the earpiece such that it is acoustically coupled to the environment external to the earpiece.

A transfer function is determined 120 based on the first electrical signal as compared to a second electrical signal used to drive a speaker in the earpiece. The transfer function may be a magnitude transfer function, a phase transfer function, or a transfer function having both magnitude and phase characteristics. The transfer function may be determined in a number of ways. For example, the transfer function may be determined for a single frequency, a number of discrete frequencies, and/or one or more frequency ranges. The second electrical signal may include a single frequency (tone), a combination of discrete frequencies, one or more frequency bands, or a combination of one or more tones and one or more frequency bands. In one example, a tone may a sub-audio tone (i.e., a tone below approximately 20 Hz). In an alternative example, a tone may be in a frequency range from approximately 200 Hz to about 300 Hz. In another example, the second electrical signal may be an audio content signal that may include music, speech and the like.

The method 100 further includes determining 130 an operating state of the personal acoustic device based on a characteristic of the transfer function. By way of an example, the characteristic can be a magnitude of the transfer function at one or more predetermined frequencies such as the frequency or frequencies of the second electrical signal. Alternatively, the characteristic of the transfer function may be a power spectrum over a predefined frequency range. For example, the power spectrum characteristic may be useful when the second electrical signal is an audio content signal. Determining the power spectra may include converting the first and second electrical signals into the frequency domain and performing additional processing. In another alternative, the characteristic can be a phase of the transfer function at one or more predetermined frequencies. In one non-limiting example, a predetermined frequency can be approximately 1.5 KHz corresponding to a significant separation between the phases at that frequency for the on head operating state of the users in FIG. 2B with respect to the off head operating state.

In one example, the second electrical signal for the speaker is applied for short durations at regular intervals to conserve electrical power that may be provided by a battery. The applications may be separated in time by a few second or less, for example, if the determination of the operating state is used to automatically change an audio output mode of the personal acoustic device such as pause and playback states or modes. Alternatively, the applications may be separated in time by a few minutes or more, for example, if the determination of the operating state is used to change a power state of the personal acoustic device. The duration of the application of the second electrical signal can vary. For example, if a higher frequency tone is used, the duration may be decreased so that the number of cycles in the tone is preserved. Conversely, the duration of the second electrical signal can be expanded to allow the magnitude of the second electrical signal to be decreased without degrading the signal to noise.

The method 100 may be applied to both earpieces of a personal acoustic device. If it is determined that only one of the earpieces changes its operating state, one set of operations of the personal acoustic device may be changed. In contrast, if it is determined that both earpieces have changed state, a different set of operations may be modified. For example, if it is determined that only one earpiece been changed from an on head to off head operating state, audio playback of the personal acoustic device may be paused. Audio playback may be resumed if it is determined that the earpiece changes back to an on head operating state. In another example, if it is determined that both earpieces have changed from an on head to off head operating state, the personal acoustic device may be put into a low power state to conserve electrical power. Conversely, if both earpieces are then determined to change to an on head operating state, the personal acoustic device can be changed to a normal operational power mode.

Figure 8A:
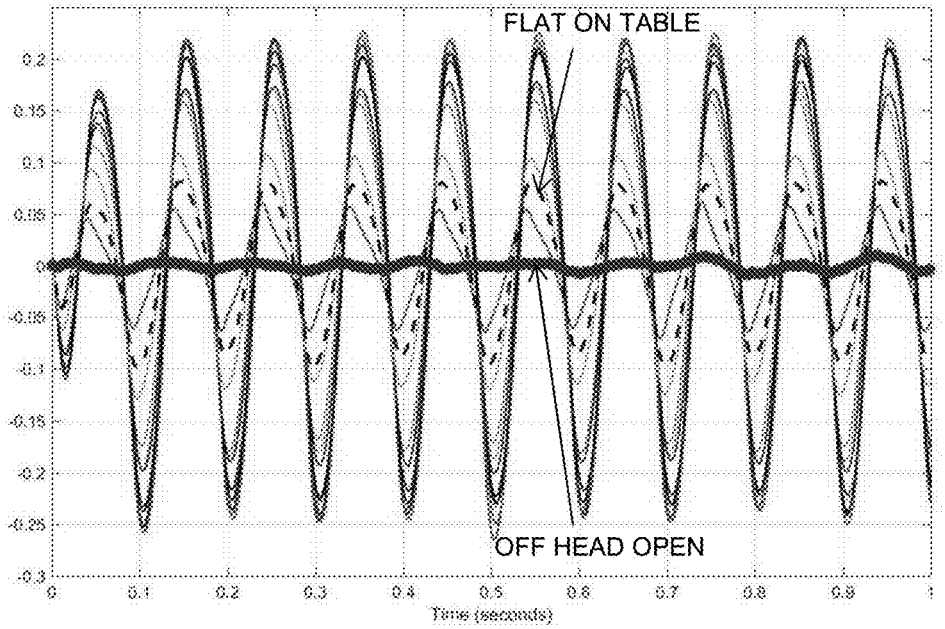
FIG. 8A shows multiple plots of signal voltage with respect to time for an inner signal generated by an inner microphone of a left earpiece.
Figure 8B:
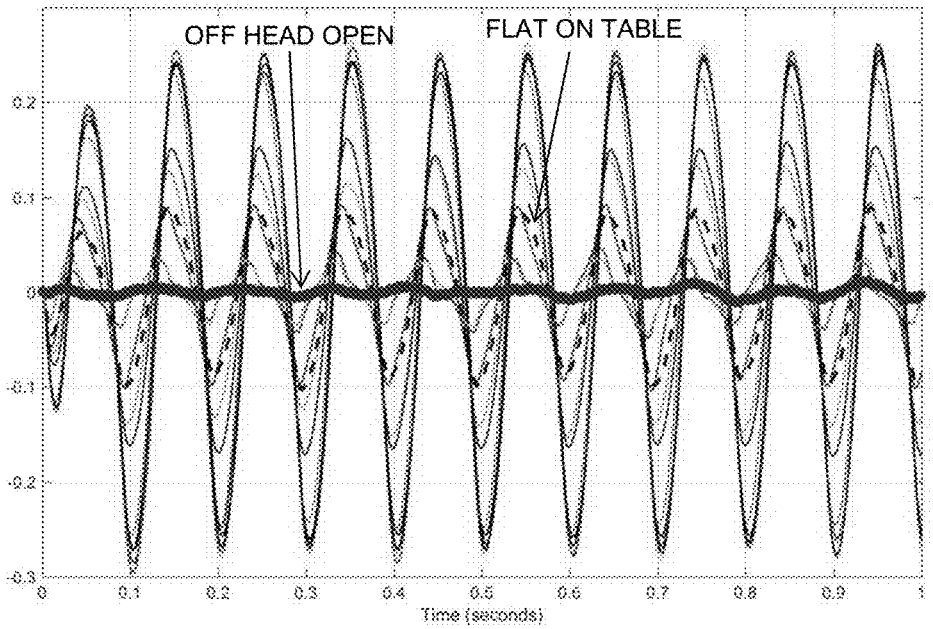
FIG. 8B shows multiple plots of signal voltage with respect to time for an inner signal generated by an inner microphone of a right earpiece.

FIG. 8A and FIG. 8B show eleven plots of signal voltage with respect to time for an inner signal generated by the internal microphone 18 of the left and right earpieces, respectively, of the headphone characterized in FIGS. 3A-4B. The drive signal for the speaker is a 0.5 volt amplitude 10 Hz tone. Each plot corresponds to a unique user with the ear-cup type earpiece in an on head state. Each figure also includes a dashed line plot which represents measurements for the ear-cup when placed "face down" flat against a table surface and a solid line plot of amplitude for the inner signal for each earpiece in the off head state.

It can be seen from the two figures that the magnitudes of the inner signal for all users in the on head state are substantially greater than the magnitude of the inner signal for the off head state. In addition, it can be seen by comparison of the two plots that there are no significant differences in the signals determined for the two ear-cups.

Figure 9A:
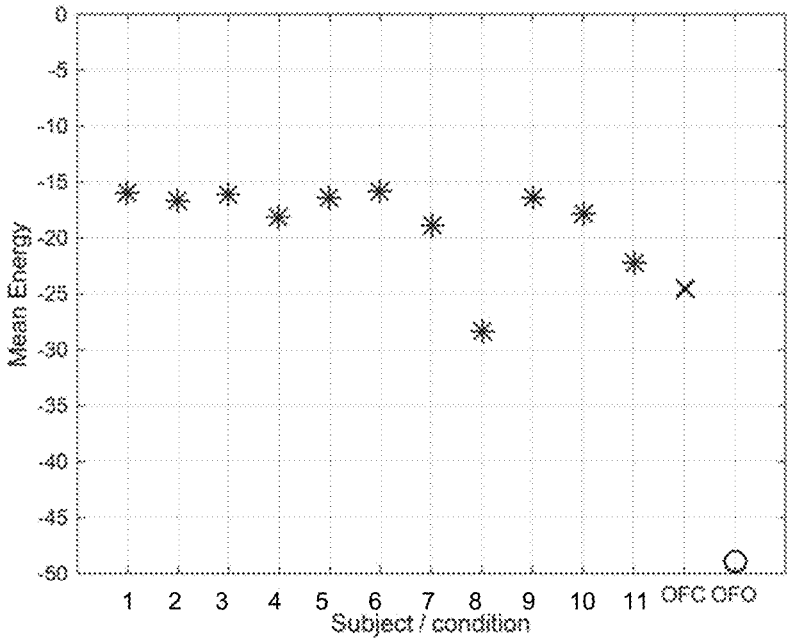
FIG. 9A shows a scatterplot of the mean energy of an inner signal for each of the users associated with the measurements of FIG. 8A.
Figure 9B:
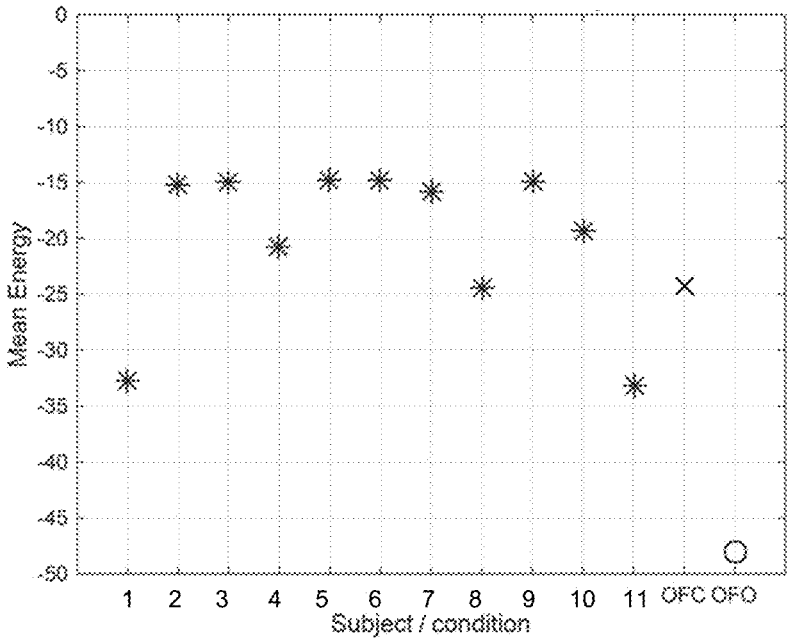
FIG. 9B shows a scatterplot of the mean energy of an inner signal for each of the users associated with the measurements of FIG. 8B.

FIG. 9A and FIG. 9B are scatterplots of the mean energy of the inner signal for each of the eleven users associated with the measurements of FIG. 8A and FIG. 8B, respectively. Each scatterplot also includes an "OFC" data point having a mean energy of approximately −24 dB and an "OFO" data point having a mean energy of approximately −48 dB. The OFC data point corresponds to the earpiece positioned flat on the table and the OFO data point corresponds to the earpiece in the off head state. There is one user data point in FIG. 9A and two user data points in FIG. 9B that have mean energies that are less than the mean energy of the OFC data point. These three user data points are indicative of a poorer fit of the earpiece to the head of the user; however, it will be noted that these data points correspond to mean energies that are substantially greater than the OFO off head data points and therefore indicate the suitability of the method even for instances when an earpiece may not be properly positioned with respect to the user.

The particular characteristic of the transfer function employed in the methods described above, and whether an inner microphone signal, and outer microphone signal, or both are used, may be based on the type of headset. For example, a headset with around-ear earpieces may utilize the method based on the magnitude characteristic of the transfer function for determining the operating state and an in-ear headset may utilize the method based on the phase characteristic of the transfer function. In some implementations the method is based on both magnitude and phase characteristics of the transfer function. Moreover, the method can be used in combination with one or more other methods for determining the operating state of the earpiece or to confirm a determination made by a different method of determining the operating state. For example, the above methods could be used to confirm a determination made from a proximity sensor (e.g., a capacitance sensor) and/or a motion sensor (e.g., accelerometer) sensing that the earpiece is off head.

In various examples described above, a feedback (or internal) and/or feedforward (or external) microphone is used; however, it should be recognized that the microphone(s) do not have to be part of an ANR system and that one or more independent microphones may instead be used.

A number of implementations have been described. Nevertheless, it will be understood that the foregoing description is intended to illustrate, and not to limit, the scope of the inventive concepts which are defined by the scope of the claims. Other examples are within the scope of the following claims.

What is claimed is:

1. A method of controlling a personal acoustic device comprising:

generating a first electrical signal responsive to an acoustic signal incident at a microphone disposed on an earpiece of the personal acoustic device;

determining a characteristic of a phase transfer function based on the first electrical signal and a second electrical signal provided to a speaker in the earpiece; and determining an operating state of the personal acoustic device based on the characteristic of the phase transfer function, the operating state comprising at least a first state in which the earpiece is positioned in the vicinity of an ear of a user and a second state in which the earpiece is absent from the vicinity of the ear.

2. The method of claim 1 wherein the microphone is disposed at a location on the earpiece such that the microphone is in an acoustic cavity formed by the earpiece and at least one of a head of a user or the ear of the user when the earpiece is positioned in the vicinity of the ear of the user.

3. The method of claim 1 wherein the microphone is disposed at a location on the earpiece such that the microphone is acoustically coupled to an environment external to the earpiece.

4. The method of claim 1 wherein the characteristic of the transfer function is a power spectrum over a predefined frequency range.

5. The method of claim 1 wherein the characteristic of the phase transfer function is a phase at a predetermined frequency.

6. The method of claim 1 wherein the second electrical signal comprises a tone.

7. The method of claim 6 wherein the tone is less than 20 Hz.

8. The method of claim 6 wherein the tone is in a frequency range from about 5 Hz to about 300 Hz.

9. The method of claim 6 wherein the tone is in a frequency range from about 300 Hz to about 1 KHz.

10. The method of claim 5 wherein the second electrical signal comprises a tone at about 1.5 KHz.

11. The method of claim 1 wherein the second electrical signal comprises an audio content signal.

12. The method of claim 1 further comprising generating the second electrical signal.

13. The method of claim 1 wherein the steps of generating the first electrical signal and determining the characteristic of the phase transfer function are performed for each earpiece in a pair of earpieces, and wherein the step of determining the operating state of the personal acoustic device further includes comparing the characteristic of the phase transfer functions of the earpieces.

14. The method of claim 1 further comprising initiating an operation of the personal acoustic device or a device in communication with the personal acoustic device when the determining of the operating state of the personal acoustic device indicates a change in the operating state.

15. The method of claim 14 wherein initiating the operation comprises at least one of: changing a power state, changing an active noise reduction state and changing an audio output state of the personal acoustic device or a device in communication with the personal acoustic device.

16. The method of claim 1 wherein the earpiece is one of an in-ear headphone, an on-ear headphone or an around-ear headphone.

17. A personal acoustic device comprising:

an earpiece having a microphone and configured for attachment to a head of a user or an ear of the user, the microphone configured to generate a first electrical signal responsive to an acoustic signal incident at the microphone, the earpiece having a speaker configured to generate an audio signal in response to a second electrical signal; and a control circuit in communication with the microphone to receive the first electrical signal and in communication with the speaker for providing the second electrical signal, the control circuit configured to:

determine a characteristic of a phase transfer function based on the first electrical signal and the second electrical signal; and determine an operating state of the personal acoustic device based on the characteristic of the phase transfer function, the operating state comprising at least a first state in which the earpiece is positioned in the vicinity of the ear and a second state in which the earpiece absent from the vicinity of the ear.

18. The personal acoustic device of claim 17 wherein the microphone is disposed at a location on the earpiece such that the microphone is in an acoustic cavity formed by the earpiece and at least one of the head or the ear when the earpiece is positioned in the vicinity of the ear of the user.

19. The personal acoustic device of claim 17 wherein the microphone is disposed at a location on the earpiece such that the microphone is acoustically coupled to an environment external to the earpiece.

20. The personal acoustic device of claim 17 wherein the control circuit comprises a digital signal processor.

21. The personal acoustic device of claim 17 wherein the microphone is a feedback microphone in an acoustic noise reduction circuit.

22. The personal acoustic device of claim 17 further comprising a power source in communication with the control circuit and wherein the control circuit is further configured to change a power state of the personal acoustic device when the operating state of the earpiece is determined to have changed.

23. The personal acoustic device of claim 17 further comprising a device in communication with the control circuit and wherein the control circuit is configured to control an operation of the device in response to a determination that the operating state of the earpiece is determined to have changed.

* * * * *